United States Patent [19]

Asayama

[11] 3,938,344

[45] Feb. 17, 1976

[54] EARTH AUGER AND METHOD FOR DRIVING PILES AND THE LIKE BY MEANS OF SAID EARTH AUGER

[75] Inventor: Kingo Asayama, Hirakata, Japan

[73] Assignee: Kabushiki Kaisha Takechi Koumusho, Osaka, Japan

[22] Filed: Apr. 29, 1974

[21] Appl. No.: 465,091

[52] U.S. Cl. ..... 61/53.66; 61/41 A; 61/53.6; 52/155; 52/160; 175/171

[51] Int. Cl.[2] ..... E02D 5/34; E02D 5/74

[58] Field of Search ..... 61/53.5, 53.52, 53.6, 53.64, 61/53.66, 56.5, 41, 63, 53.62; 175/171, 263, 388, 292; 52/155, 160

[56] References Cited

UNITED STATES PATENTS

| | | | |
|---|---|---|---|
| 2,912,228 | 11/1959 | Kandle | 175/292 |
| 3,420,320 | 1/1969 | Washita | 61/53.5 X |
| 3,422,629 | 1/1969 | Watts | 61/53.52 |
| 3,499,293 | 3/1970 | Kato | 61/53.64 |
| 3,530,675 | 9/1970 | Turzillo | 61/53.6 X |
| 3,742,717 | 7/1973 | Wey | 61/53.6 |
| 3,864,923 | 2/1975 | Turzillo | 61/53.6 |

*Primary Examiner*—Jacob Shapiro
*Attorney, Agent, or Firm*—Price, Heneveld, Huizenga & Cooper

[57] ABSTRACT

An earth auger is disclosed in which an auger shaft is provided with freely expansible and contractible rotary blades in such manner that said rotary blades may expand automatically when said auger shaft is rotated in the forward direction and may contract automatically when said auger shaft is rotated in the reverse direction. Also a method for driving piles and the like is disclosed which comprises the steps of positioning a pile or shoring adjacent to said auger shaft and above said blades, advancing said pile or the like into an earth bore excavated by said rotary blades, and filling said bore excavated by the rotary blades with mortar or the like.

4 Claims, 17 Drawing Figures

EARTH AUGER AND METHOD FOR DRIVING PILES AND THE LIKE BY MEANS OF SAID EARTH AUGER

The present invention relates to an earth auger for driving hollow ready-made piles made of concrete and sheet piles into a formation to provide a foundation for constructing a building, and also to a method for driving shoring type piles and the like.

When a pile is driven by means of an earth auger, depending upon the hardness of the foundation earth, augers proper for the respective foundations are used. Accordingly, in cases where the hardness of the ground formation to be excavated varies depending upon its depth, it is necessary to change the earth auger from time to time, and, in some cases, the pile must be driven by a percussion process. In addition, upon inserting a pile into a bore excavated by an earth auger, the frictional resistance between the pile and the wall of the bore makes it difficult to insert the pile.

Therefore, it is a principal object of the present invention to provide an earth auger which does not have to be changed from time to time or to be replaced by a machine utilizing a different process even if the nature of the earth formation varies depending upon its depth.

Another object of the present invention is to provide means for making rotary blades expand automatically when an auger shaft is rotated in the forward direction to have a somewhat larger diameter than the outer diameter of a pile to be driven, and for making said rotary blade contract automatically to have a somewhat smaller diameter than an inner diameter of said pile when said auger shaft is rotated in the reverse direction.

Still another object of the present invention is to provide means enabling the earth auger to be withdrawn up to the ground surface leaving only the pile in the earth after the pile has been driven into an earth formation.

Yet another object of the present invention is to provide an earth auger and a method for operating the same such that a bulb-like portion formed at the bottom end of a pile may be formed in tight contact with the earth formation.

A still further object of the present invention is to provide an earth auger and a method for operation the same in which the frictional resistance between the pile and the wall of the bore during driving the pile into the formation may be reduced.

In order to achieve the aforementioned objects, the present invention provides an earth auger in which a screw-shaped cutting blade is formed around an outer circumference of an auger shaft, a hub having stoppers for rotary blades is mounted on said auger shaft above said cutting blade, and rotary blades are pivotably mounted on said hub so that they may freely expand and contract. The present invention also provides a method for driving piles comprising the steps of loosely fitting a ready-made hollow concrete pile around said earth auger at a position above said rotary blade, driving the pile into the earth formation while it surrounds the earth auger while excavating a bore or hole for the pile, and thereafter filling the excavated bore with mortar or the like through an inner hollow space of said auger.

These and other objects and features of the present invention will be more fully understood from the following description of the invention given in connection with the illustrated embodiments in the accompanying drawings, in which.

Figure 1:
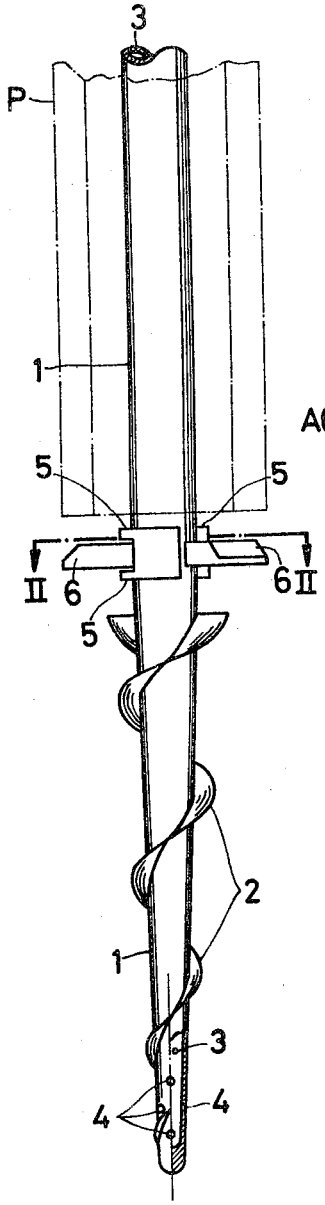
FIG. 1 is a side view showing one preferred embodiment of the present invention.

Referring now to the accompanying drawings, in FIG. 1 reference numeral 1 designates an auger shaft of inverted conical shape. A spiral cutting blade 2 is provided outside of said auger shaft 1. A hollow water feeding bore or conduit 3 is formed inside the auger shaft 1, and in the bottom portion of said auger shaft spray openings 4 are provided as by drilling. In addition, in the upper portion of the earth boring section of the auger shaft 1 is provided a hub 5, on which rotary blades 6 are pivotably mounted with pins 7 in a freely expansible and contractible manner. The rotary blades 6 are adapted to be engaged by stoppers 8 when they expand.

Figure 2:
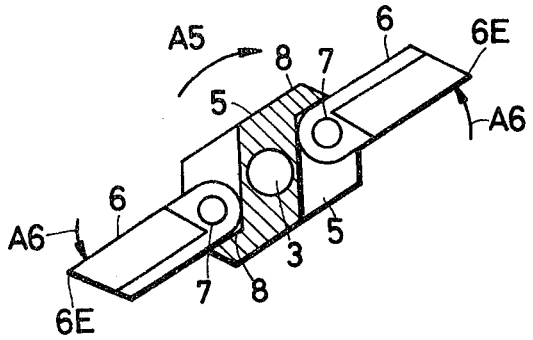
FIG. 2 is an enlarged transverse cross section view of the same taken along line II-II in FIG. 1.

When the hub 5 is rotated in the direction of arrow A5 shown in FIG. 2, owing to resistive forces of the earth exerted upon the tip ends of the rotary blades 6, the rotary blades 6 are pivoted about the pins 7 in the direction of arrow A6 until they strike against the stoppers 8, which prevents further pivoting. In this case, the diameter of the circular locus of rotation of the tip ends 6E of the blades 6 assumes its maximum value.

Figure 3:
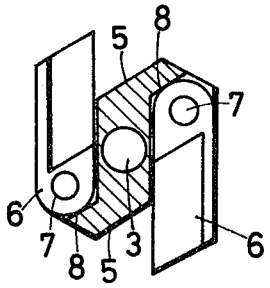
FIG. 3 is an enlarged transverse cross section view showing the same part as shown in FIG. 2 but in a different state.

On the contrary, if rotation of the hub 5 is reversed, that is, if it is rotated in the opposite direction to the direction of arrow A5 shown in FIG. 2, then the rotary blades 6 are pivoted about the pins 7 in the opposite direction to the direction of arrow A6 and thus occupy the positions as shown in FIG. 3. In this case, the diameter of the circular locus of rotation of the tip ends 6E of the blades 6 assumes its minimum value.

In addition, during the boring process, water is fed through the water feeding bore 3 to be sprayed from the spray openings 4.

Figure 4:
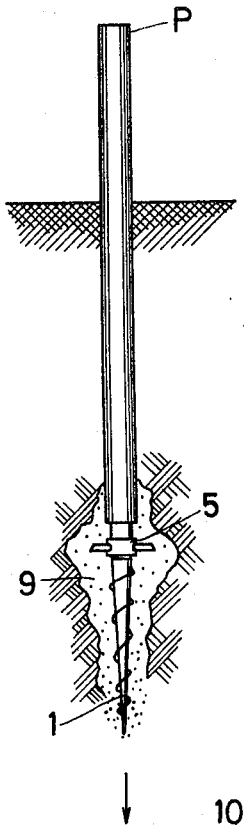
FIGS. 4 and 5 are longitudinal cross section views showing successive states of operation of the earth auger according to the present invention.

To drive in the earth a ready-made hollow cylindrical pile P using the aforementioned earth auger, firstly the auger is inserted through the pile P, and then the auger shaft 1 is rotated under the conditions shown in FIG. 4 while spraying water from the spray openings 4.

Owing to the rotation of the spiral cutting blade surrounding the outer circumference of the head of the auger shaft 1, the auger shaft 1 advances into the earth, while the rotary blades 6, above said spiral cutting blade 2, expand into the position shown in FIG. 2 as described above, so that said rotary blades 6 excavate the earth beneath the end of the pile while rotating, and thus advance the pile P positioned thereabove downwardly to insert it into the excavated bore.

Figure 5:
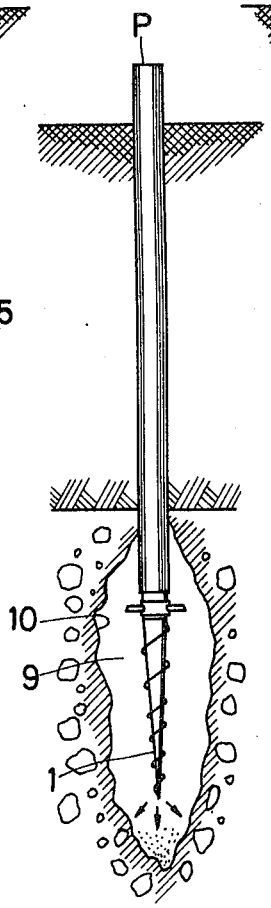
Figure 6:
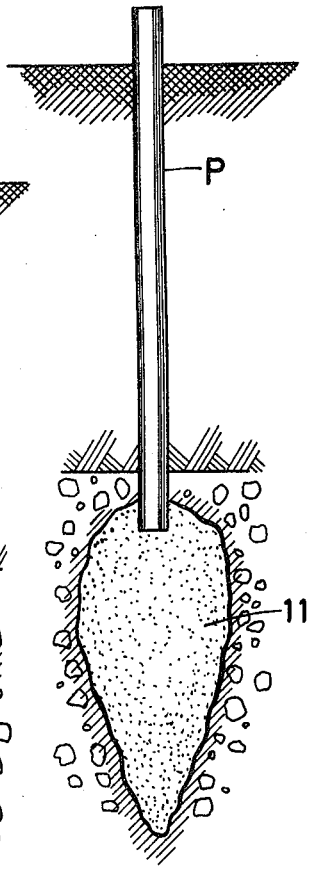
FIG. 6 is a longitudinal cross section view showing a completely driven and fixed state of a pile.
Figure 7:
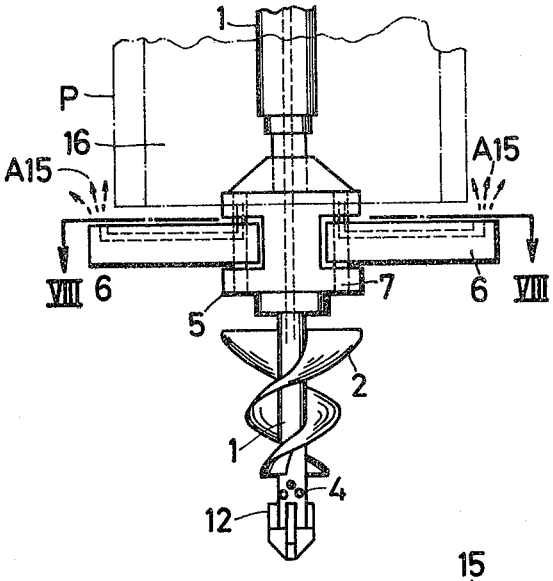
FIG. 7 is a side view showing another preferred embodiment of the present invention.
Figure 9:
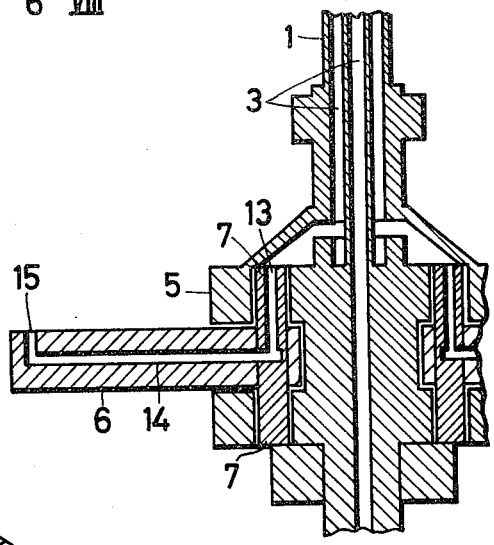
FIG. 9 is an enlarged longitudinal cross section view showing a part of the structure shown in FIG. 7.
Figure 8:
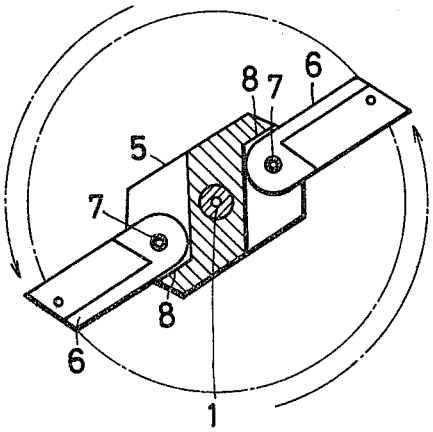
FIG. 8 is a transverse cross section view of the same taken along line VIII—VIII in FIG. 7.
Figure 10:
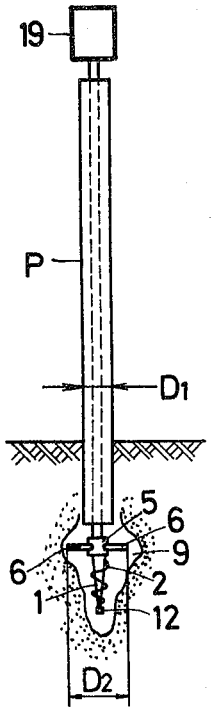
FIGS. 10 through 12 are longitudinal cross section views showing successive states of operation of the second embodiment.

In FIGS. 4 to 6, means for suspending the pile P as well as means for rotating the auger shaft 1 are omitted from illustration, because any conventional means are available therefor.

When the boring process has proceeded up to the state shown in FIG. 5, the rotation of the auger shaft 1 is stopped, the spraying of water from the spray openings 7 is interrupted, and then mortar is injected into the cavity 9 formed in the earth. The injection of mortar into the cavity 9 is carried out through the water feeding bore 3 and the spray openings 4.

Since the inside of the cavity 9 has been washed by water sprayed from the spray openings 4 during the boring process, the inside wall surface of the cavity 9 is the exposed surface of the supporting earth formation 10. Consequently, the subsequent mortar filling makes direct, tight contact with the supporting earth formation 10, so that a soft, weak portion or pocket is not formed between the peripheral surface of a bulb portion 11 and the supporting earth formation 10.

When the injection of mortar has finished, the auger shaft 1 is rotated in the opposite direction to the direction of arrow A5 to fold and contract the rotary blades 6 into the state shown in FIG. 3, and then the auger shaft 1 is withdrawn up to the ground surface through the axial bore of the pile P left in the earth, resulting in the condition shown in FIG. 6, where a perfect bulb 11 is formed.

In a modified embodiment shown in FIGS. 7 to 12, reference numerals 1 to 11 and reference character P designate those elements having the same functions as the elements in the first embodiment indicated by like numeral or character. Reference numeral 12 designates a drill tip portion, numeral 13 designates water passageways drilled in the pins 7, numeral 14 designates water passageways formed in the respective rotary blades 6, and reference numeral 15 designates water spray openings in the rotary blades 6. The water fed through the water feeding bore 3 is passed through the water passageways 13 and 14, and sprayed in the direction of arrow A15 from the spray openings 15.

A ready-made hollow pile P is erected on a predetermined ground surface for driving said pile, an auger shaft 1 provided with said rotary blades 6 is inserted into an axial bore 16 in said pile P, the top portion of said auger shaft 1 is suspended together with the pile P from a pile driving machine (not shown), and under such a condition the auger shaft 1 is rotated via an auger speed reduction mechanism 19.

The portion of the earth under the pile P is drilled by means of the drill tip portion 12 and the spiral cutting blade 2, and simultaneously therewith the rotary blades 6 are expanded into the illustrated state by the friction with the ground surface, so that the earth around the pile P can be also excavated by said expanded rotary blades 6.

Then, since the outer diameter $D_2$ of the rotary blades 6 upon rotation is preselected to be somewhat larger than the outer diameter $D_1$ of the pile P, between the bore excavated by the rotary blades 6 and the outer circumference of the pile P a clearance space 17 is formed.

In this way, the pile P is advanced into the bore excavated by the rotary blade 6, so that the pile P can be inserted up to a desired depth while reducing the friction between the pile P and the earth foundation.

Figure 11:
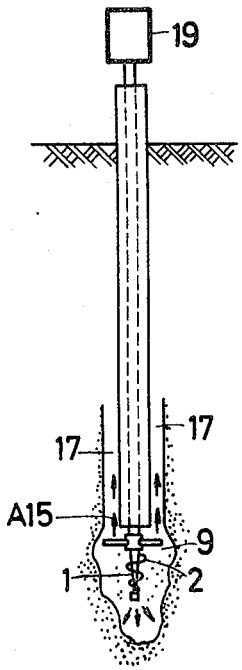
Figure 12:
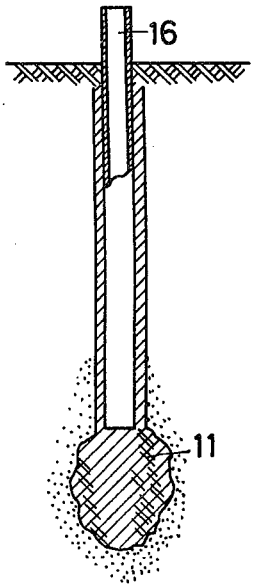

Sometimes, depending upon the nature of the earth formation, simultaneously with the rotation of the auger shaft 1, water is sprayed from spray openings 15 in the rotary blades 6 in the direction of arrow A15 in FIG. 11 to reduce the resistance to the rotation of the rotary blades 6 in addition to the reduction of the frictional resistance around the pile P.

After the pile P has been inserted to a predetermined position as shown in FIG. 11, the rotation of the auger shaft 1 is stopped, the spraying of water from the spray openings 4 and 15 is interrupted. Then mortar is injected into a cavity 9 formed in the earth through said water feeding bore 3, water spray openings 4, water passageways 13 and 14 and water spray openings 15. Similarly to the case of the first embodiment, as described previously, the injected mortar makes direct tight contact with the exposed earth formation on the inside surface of the cavity 9, and thereby the bulb portion 11 formed at the bottom of the pile P is firmly supported by the earth formation. According to the second embodiment, the clearance space 17 between the outer circumference of the pile P and the inner wall of the excavated bore in the earth is filled with mortar simultaneously with the filling of cavity 9 with mortar. This is done through the water feeding bore 3 in the auger shaft 1, or by separate injection of mortar directly into the clearance space 17. By this means the pile can be more firmly supported by the earth formation.

When the injection of mortar through the water feeding bore 3 has been finished, the auger shaft 1 is rotated in the reverse direction to fold and contract the rotary blades 6 as shown in FIG. 3. The auger shaft 1 is then completely withdrawn from the pile P through its axial bore 16, while leaving only the pile P in the earth.

In a further modified embodiment shown in FIGS. 13 to 17, reference numerals 1 to 12 designate those elements having the same functions as the elements indicated by like numerals in FIGS. 1 to 12. Reference character S designates a non-tubular, sheet or plate type pile of the type used for shoring. Reference numeral 18 designates junctions or interlocks formed on the opposite edges of the sheet pile S. Numeral 19 designates an auger speed reduction mechanism, and numeral 6E designates tip end portions of the rotary blades 6.

Figure 13:
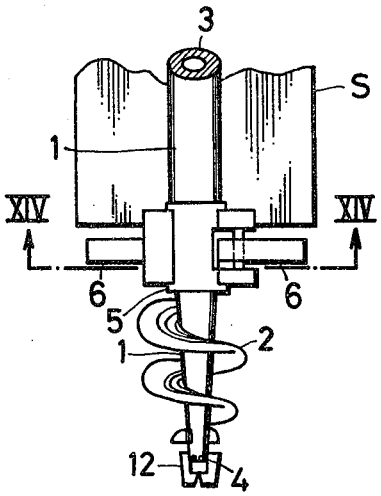
FIG. 13 is a side view of a still another embodiment of the present invention.
Figure 14:
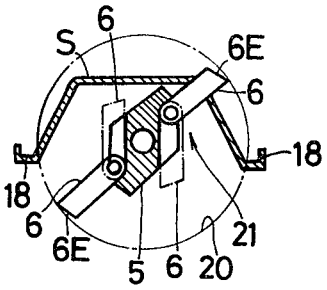
FIG. 14 is a transverse cross section view of the same taken along line XIV—XIV in FIG. 13 as viewed in the direction of the arrow.

When a sheet pile S is driven into the earth by making use of the subject earth auger, the auger shaft 1 and the sheet pile S are suspended by a pile driving machine (not shown) while maintaining their relative positions as shown in FIGS. 13 and 14. In more particular, the bottom end of the sheet pile S is positioned above the rotary blades 6, and the relative position along the horizontal plane is selected in such manner that the center of the central channel 21 of the sheet pile S is concentric with the circular locus 20 of rotation of the tip ends 6E of the rotary blades 6.

Under the above-mentioned condition, water is sprayed from the water spray openings 4 as the auger shaft 1 is rotated, whereby a bore having the same size as said circular locus 20 is formed by means of the drill tip portion 12, screw-shaped cutting blade 2 and the rotary blades 6. The sheet pile S is inserted into the bore.

Figure 15:
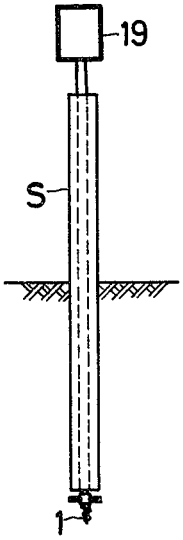
FIGS. 15 through 17 are longitudinal cross section views showing successive states of operation of the third embodiment.

This state intermediate of the pile driving process is shown in FIG. 15. After the sheet pile S has been inserted into the earth up to the desired predetermined depth, the auger shaft 1 is rotated in the reverse direction to fold and contract the rotary blades 6 into the retracted state shown in phantom in FIG. 14, and then the auger shaft 1 is withdrawn upwardly. During the withdrawing step, a relatively lean-mix filling material consisting of sand, cement, mortar and the like is filled into the bore formed by the earth auger. Thereby the sheet pile S is completely embedded in the earth formation.

Since a mixture having substantially similar mechanical strength to the earth formation around the sheet pile S is employed as said lean-mix filling material, said filling material does not obstruct the work of withdrawing the sheet piles S from the earth formation after the construction has been finished.

Figure 16:
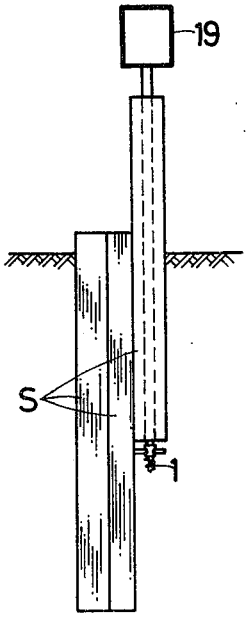
Figure 17:
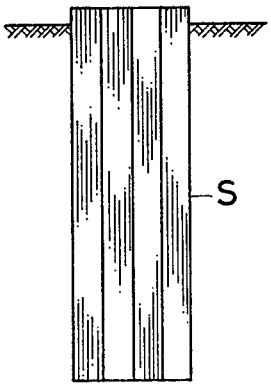

The same process as that described above is repeated as another sheet pile S is placed adjacent to the thus previously embedded sheet pile S. The piles are interconnected by the junctions or interlocking flanges 18 of the respective sheet piles S. In this manner, a number of sheet piles S are embedded in the earth as shown in FIG. 16. Finally, a great number of sheet piles S can be completely embedded in the earth as shown in FIG. 17.

The embedding of the sheet piles S according to the above-described method produces very little noise in contrast to the prior art process of driving with a hammer. Using this invention, embedding is possible in any earth formation, and the work of withdrawing the sheet piles when they are no longer required is simpler.

Although in the foregoing description reference has been made to embedding piles of the sheet type, obviously other types of piles such as those consisting of H-type steel beams or the like can be similarly embedded in place of the sheet piles.

While we have described above the principle of our invention in connection with specific apparatus, it is to be clearly understood that this description is made only by way of example and not as a limitation to the scope of the invention as set forth in the objects thereof and in the accompanying claims.

The embodiments of the invention in which an exclusive property or privilege is claimed are defined as follows:

1. The method of setting and anchoring a tubular piling including the steps of placing the piling in the ground; inserting an auger having a ground formation boring head through the piling until the head is below the lower end of the piling; rotating the auger and expanding the diameter of the ground cutting elements to a diameter substantially greater than that of the piling and while the cutting elements are so expanded boring a hole larger than said piling and progressively lowering both the piling and the auger until the desired depth of ground penetration of the piling has been obtained; then while holding the piling stationary forming an enlarged cavity beneath the lower end of the piling, injecting a mortar-like substance into and filling the cavity and injecting additional quantities of the mortar-like substance in the annular space between the walls of the bore in the ground and the piling until the annular space is filled; withdrawing the auger through the piling while the cutter elements are contracted.

2. The method of setting and anchoring a tubular piling as described in claim 1 including the additional steps of also filling the hollow piling with the mortar-like substance as the auger is withdrawn.

3. Method of driving and anchoring piles by means of an earth auger having a boring head with both a spiral and expandable rotary cutting blades, including the steps of inserting an earth auger through a ready-made hollow cylindrical pipe with a loose fit until the auger's spiral and rotary cutting blades project from the lower end of said hollow cylindrical pipe, rotating said auger and simultaneously discharging water under pressure from spray openings in said boring head, advancing said boring head and auger shaft into the earth foundation to form an opening larger than said pipe and advancing said cylindrical pipe through said opening as said auger advances until the lower end of said pipe has reached a predetermined depth, stopping further advancement of said pipe while continuing rotation of the auger with the expandable cutting blades extended and simultaneously continuing to discharge water under pressure to form a chamber below the end of said pipe substantially larger in diameter than said pipe and generally shaped as an inverted cone, stopping both the rotation of said auger shaft and the spraying of the water when said chamber has attained a predetermined depth and cross section, discharging mortar from said spray openings into the cavity excavated by said spiral blade and rotary blades to form a bulb shaped mass at and engaging a portion of the lower end of said hollow cylindrical pile, reversing the direction of rotation of said auger shaft and withdrawing the auger shaft through said pipe while said rotary blades are folded.

4. Method of driving and anchoring piles by means of an earth auger as claimed in claim 3 further characterized by the step of jetting mortar under pressure from the spray openings in the boring head to fill the annulus formed between the outer surface of the pipe and the surrounding earth formation.

* * * * *